US008237345B2

(12) United States Patent
Kobayashi et al.

(10) Patent No.: US 8,237,345 B2
(45) Date of Patent: Aug. 7, 2012

(54) DISPLAY APPARATUS WITH CONDUCTIVE FRAME

(75) Inventors: Fumikazu Kobayashi, Zama (JP); Yohei Hashizume, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 97 days.

(21) Appl. No.: 12/958,345

(22) Filed: Dec. 1, 2010

(65) Prior Publication Data

US 2011/0127901 A1 Jun. 2, 2011

(30) Foreign Application Priority Data

Dec. 2, 2009 (JP) ..... 2009-274966

(51) Int. Cl.
*H01J 17/49* (2006.01)

(52) U.S. Cl. ..... 313/495; 313/283

(58) Field of Classification Search ..... 313/495–497, 313/283–284; 445/25
See application file for complete search history.

(56) References Cited

U.S. PATENT DOCUMENTS

| | | | | |
|---|---|---|---|---|
| 5,965,978 | A | 10/1999 | Kishino | |
| 6,252,349 | B1 | 6/2001 | Inoue | |
| 2002/0021081 | A1 | 2/2002 | Tajima | |
| 2004/0008195 | A1 | 1/2004 | Kawase | |
| 2007/0096622 | A1 * | 5/2007 | Yamada et al. | 313/495 |

FOREIGN PATENT DOCUMENTS

| | | | |
|---|---|---|---|
| JP | 06-053680 | A | 2/1994 |
| JP | 10-31433 | A | 2/1998 |
| JP | 2000-133173 | A | 5/2000 |
| JP | 2001-332198 | A | 11/2001 |
| JP | 2003-092075 | A | 3/2003 |
| JP | 2004-087474 | A | 3/2004 |

* cited by examiner

*Primary Examiner* — Anne Hines
(74) *Attorney, Agent, or Firm* — Canon USA Inc IP Division

(57) ABSTRACT

The display apparatus includes an airtight container having an insulating first substrate, an insulating second substrate which faces the first substrate, a conductive frame arranged between the first substrate and the second substrate, a conductive layer which is provided between the conductive frame and the first substrate and which is airtightly bonded to the conductive frame, and an insulating layer which is provided between the conductive layer and the first substrate and which airtightly bonds between the conductive layer and the first substrate; a display unit provided inside the airtight container; wires connected to the display unit; and electrodes. The insulating layer insulates the wires from the conductive frame and the electrodes and has through-holes penetrating from the electrodes toward the conductive frame, and the conductive layer is connected to the electrodes through the through-holes.

4 Claims, 8 Drawing Sheets

DISPLAY APPARATUS WITH CONDUCTIVE FRAME

BACKGROUND OF THE INVENTION

1. Field of the Invention

The present invention relates to a display apparatus and more particularly relates to a display apparatus having an airtight container.

2. Description of the Related Art

In display apparatuses, such as a field emission device (FED), a display unit formed of electron-emitting devices, luminous layers, and the like is provided inside an airtight container. In addition, wires are connected to the electron-emitting devices from the outside of the airtight container, and a voltage is applied to the wires, so that the electron-emitting devices are driven. A fluorescent film is bombarded with electrons emitted from the electron-emitting device, and the luminous layer emits light in accordance with an emission current. In order to obtain a stable emission current, the airtight container is required to have high airtightness.

On the other hand, since the airtight container is formed by sealing peripheral portions of a pair of insulating substrates, an abnormal potential distribution may occur in some cases due to charging of the airtight container, a potential applied to the display unit, and/or a current flowing therethrough. In particular, in the vicinities of the peripheral portions of the substrates (sealed portions), an abnormal potential distribution is liable to occur. The abnormal potential distribution as described above may cause abnormal discharge and eventually may lead to damage, such as disconnection of wires, to the display apparatus.

Japanese Patent Laid-Open No. 2004-087474 has disclosed that the potential is set using a conductive adhesion member.

SUMMARY OF THE INVENTION

In order to obtain a highly reliable display apparatus, the generation of abnormal discharge is required to be suppressed as well as the airtightness of an airtight container is ensured. Accordingly, the present invention intends to suppress the generation of abnormal discharge as well as to ensure the airtightness of an airtight container.

The present invention which solves the above problems provides a display apparatus comprising: an airtight container which includes an insulating first substrate, an insulating second substrate facing the first substrate, a conductive frame arranged between the first substrate and the second substrate, a conductive layer which is provided between the conductive frame and the first substrate and which is airtightly bonded to the conductive frame, an insulating layer which is provided between the conductive layer and the first substrate and which airtightly bonds between the conductive layer and the first substrate; a display unit provided inside the airtight container; wires which extend from the outside to the inside of the airtight container through between the first substrate and the insulating layer and which are connected to the display unit; and at least one electrode which extends from the outside of the airtight container to at least between the first substrate and the insulating layer. In the display apparatus described above, the insulating layer insulates the wires from the conductive frame and the electrode and has at least one through-hole penetrating from the electrode toward the conductive frame, and the conductive layer is connected to the electrode through the through-hole.

According to the present invention, a highly reliable display apparatus can be obtained in which the generation of abnormal discharge is suppressed as well as high airtightness is ensured.

Further features of the present invention will become apparent from the following description of exemplary embodiments with reference to the attached drawings.

DESCRIPTION OF THE EMBODIMENT

Figure 1A:
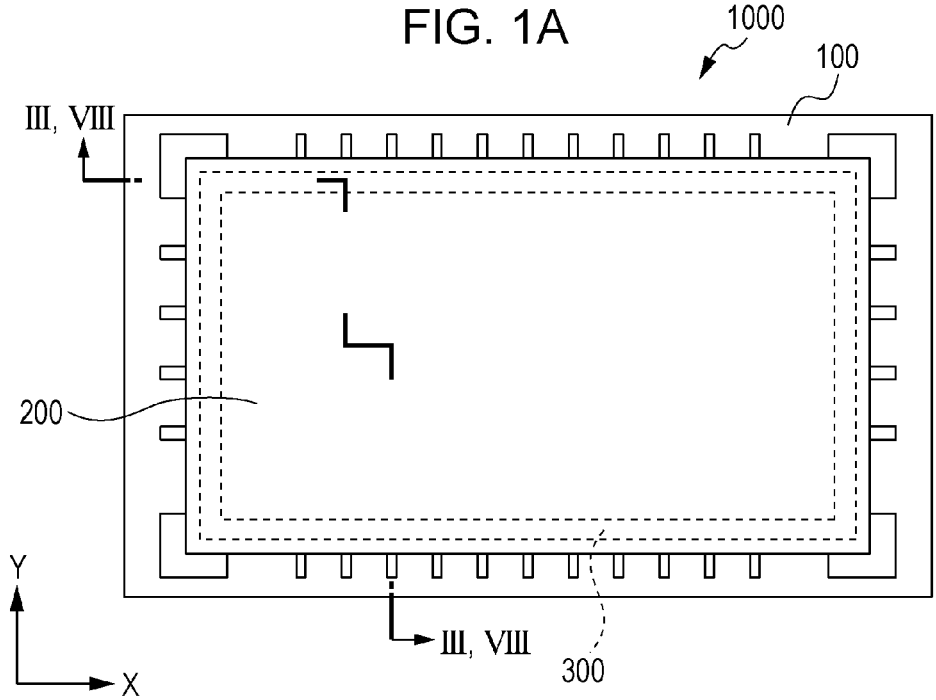
FIGS. 1A and 1B are schematic plan views each illustrating one example of a display apparatus.

Hereinafter, with reference to the drawings, an embodiment of the present invention will be described in detail. However, the present invention is not limited to the following embodiments. In each drawing, the common members are designated by the same reference numerals.

FIG. 1A is a schematic plan view of a display apparatus 1000 which is one example according to an embodiment of the present invention. The display apparatus 1000 has a rear plate 100 and a face plate 200 as shown in FIG. 1A. A portion shown by dotted lines indicates a sealing member 300. Although described later in detail, the rear plate 100, the face plate 200, and the sealing member 300 are each formed of a plurality of members.

Figure 2:
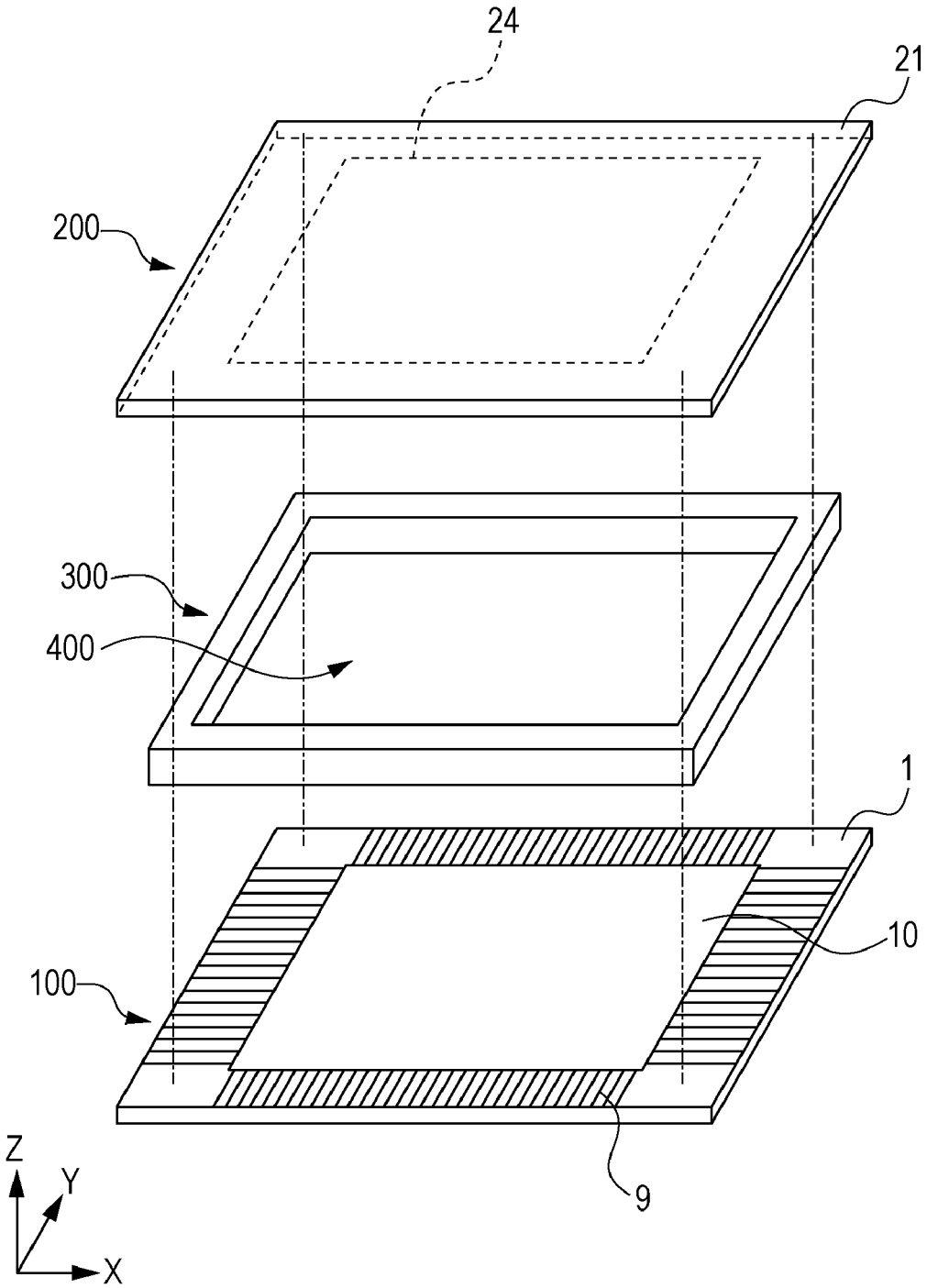
FIG. 2 is a schematic perspective view illustrating the display apparatus shown in FIGS. 1A and 1B.

FIG. 2 is an exploded schematic view of the display apparatus 1000. The rear plate 100 includes an insulating first substrate 1, matrix wires 9, and an electron source 10, the latter two being provided on the first substrate 1. The electron source 10 is connected to the matrix wires 9. The face plate 200 includes an insulating second substrate 21 and a screen member 24 provided on the second substrate 21. The rear plate 100 and the face plate 200 are arranged with the sealing member 300 in the form of a frame interposed therebetween so that the electron source 10 faces the screen member 24 and so that the first substrate 1 and the second substrate 21 face each other. The electron source 10 and the screen member 24 form a display unit. The rear plate 100 and the face plate 200 are each airtightly bonded to the sealing member 300. By the structure as described above, the airtight container which has an interior space 400 is formed from the first substrate 1, the sealing member 300, and the second substrate 21. The interior space 400 of the airtight container is held at a vacuum (of typically $1\times10^{-5}$ Pa or less) and is made airtight to the outer space of the airtight container. In addition, the inside of the airtight container indicates an inner surface of the airtight container and the interior space 400. The outside of the airtight container indicates an outer surface of the airtight container and a space (exterior space) apart from the interior space 400 than the outer surface. As described above, the display unit is provided inside the airtight container.

Figure 1B:
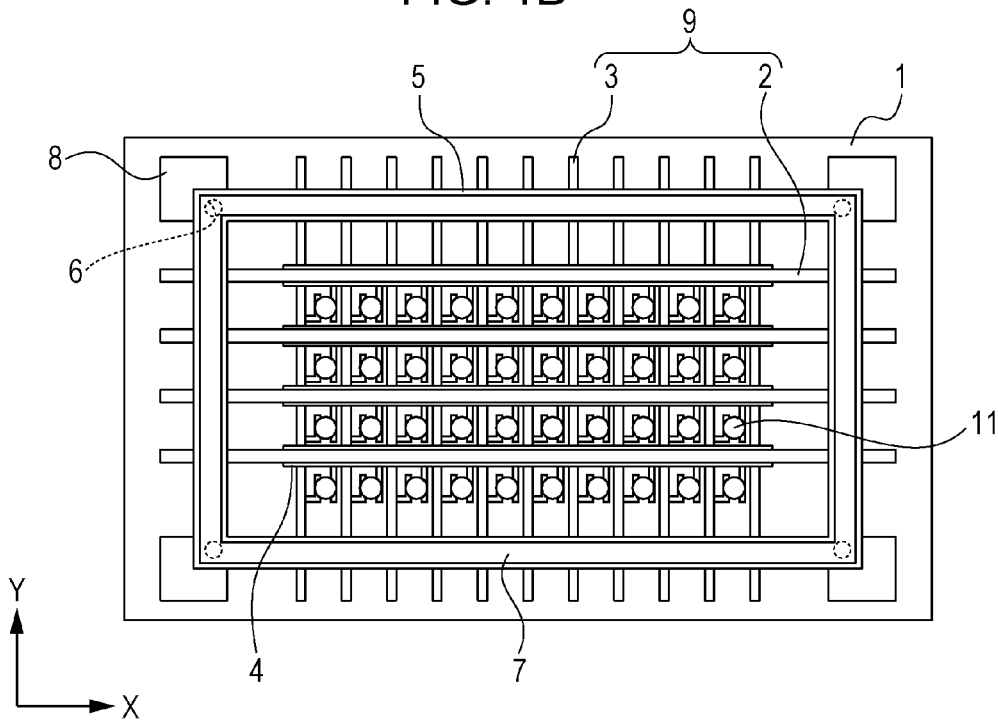

FIG. 1B is a schematic plan view illustrating in more detail one example of the structure of parts of the rear plate 100 and the sealing member 300. Reference numeral 2 indicates a row wire provided on the first substrate 1 in a direction parallel to an X direction, and reference numeral 3 indicates a column wire provided on the first substrate 1 in a direction parallel to a Y direction. The row wires 2 and the column wires 3 are arranged to intersect each other, so that the matrix wires 9 are formed. Reference numeral 4 indicates a wire insulating layer provided between the row wire 2 and the column wire 3 at an intersection therebetween in the X direction so as to insulate between the row wire 2 and the column wire 3. Reference numeral 11 indicates an electron-emitting device, and a plurality of electron-emitting devices 11 are connected to the matrix wires 9. Although a field emission type is used as the electron-emitting device 11, the type thereof is not particularly limited. Besides the surface conduction emitter type (SCE type) shown in FIG. 1B, for example, a Spindt type, a CNT type, an MIM type, an MIS type, and a BSD type may also be used. A plurality of electron-emitting devices 11 forms the electron source 10. Although the case in which wires connected to the electron source are the matrix wires is described by way of example, besides the matrix wires, so-called ladder-type wires may also be used. Reference numeral 8 indicates a potential regulating electrode provided on the first substrate 1. In FIG. 2, the potential regulating electrode 8 is not shown. As described above, the rear plate 100 is formed.

Reference numeral 5 indicates a sealing portion insulating layer which is a part of the sealing member 300 and which has a frame shape. Reference numeral 6 indicates a through-hole formed in the sealing portion insulating layer 5. Reference numeral 7 indicates a sealing portion conductive layer which is a part of the sealing member 300 and which has a frame shape provided on the sealing portion insulating layer 5. The sealing portion conductive layer 7 is partially present in the through-hole 6.

The sealing portion insulating layer 5 is formed on the first substrate 1 to have a frame shape and is provided so as to intersect and cover parts of the matrix wires 9 and parts of the potential regulating electrodes 8. As a result, the matrix wires 9 extend from the outside of the airtight container to the inside thereof through between the sealing portion insulating layer 5 and the first substrate 1 and are connected to the electron source 10 inside the airtight container. The potential regulating electrodes 8 each extend from the outside of the airtight container to at least between the sealing portion insulating layer 5 and the first substrate 1. The potential regulating electrodes 8 each may extend further to the inside of the airtight container.

Figure 3:
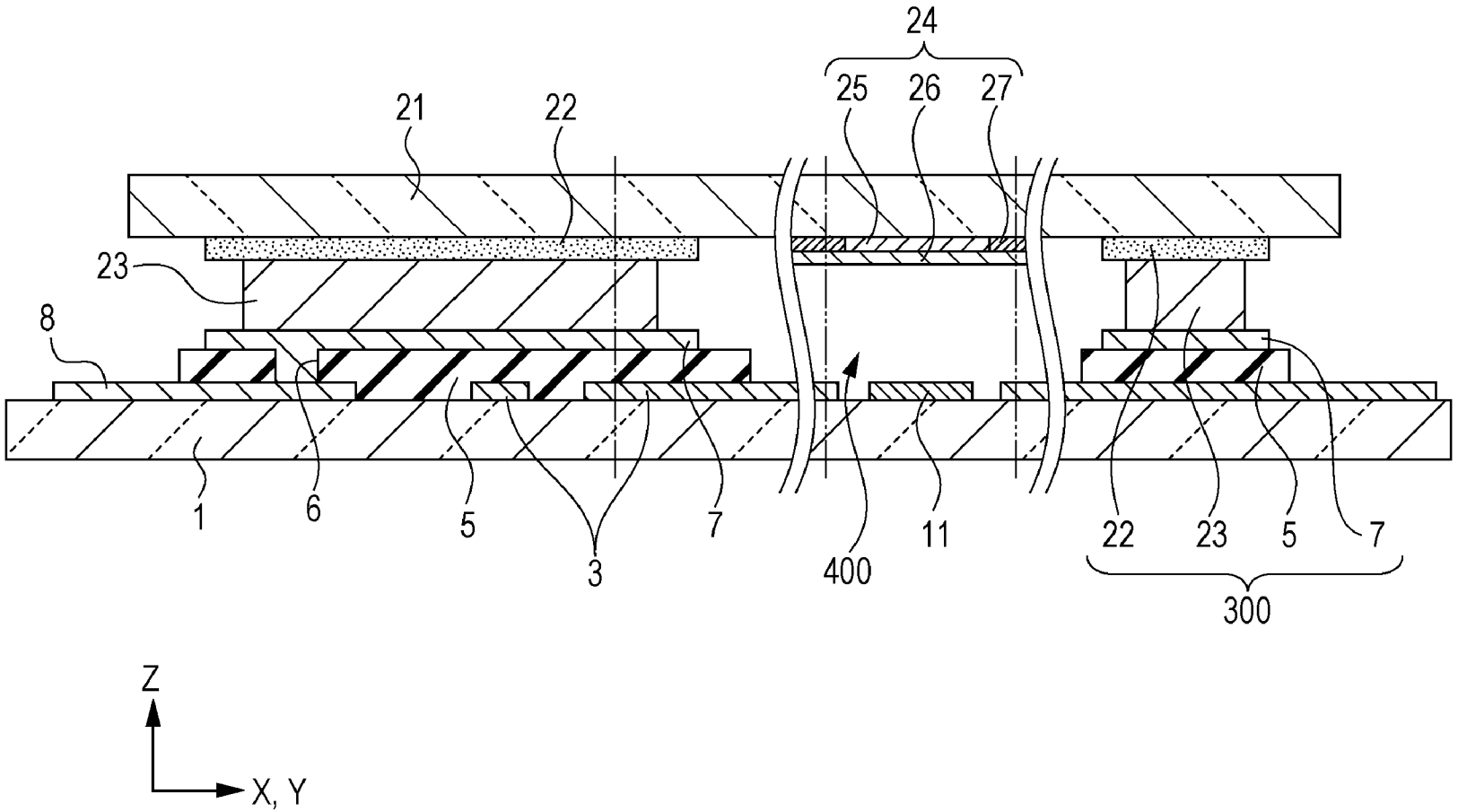
FIG. 3 is a schematic cross-sectional view illustrating the display apparatus shown in FIGS. 1A and 1B.

FIG. 3 is a schematic cross-sectional view of a portion shown by the chain line III-III in FIG. 1A. In FIG. 3, the two-dot chain lines correspond to corners at which the chain line III-III bends, and the inside of the airtight container is partially omitted.

As shown in FIG. 3, the screen member 24 includes luminous layers 25, an anode 26, and a light shielding layer 27. The luminous layers 25 are laminated on the anode 26, and the light shielding layer 27 is provided along the peripheries of the luminous layers 25. The screen member 24 and the electron-emitting devices 11 face each other to form the display unit. Electrons emitted from the electron-emitting device 11 are accelerated by an anode potential (several to several tens of kilovolts) applied to the anode 26 and collide against the luminous layer 25 with energy which is sufficient to enable the luminous layer 25 to emit light. As a result, the luminous layer 25 is excited to emit light (cathode luminescence). The luminous layer 25 can be formed of a fluorescent substance or a phosphor.

The sealing member 300 has the structure in which the sealing portion insulating layer 5, the sealing portion conductive layer 7, a conductive frame 23, and an adhesion member 22 sequentially laminated in this order from a first substrate 1 side. The sealing portion insulating layer 5 airtightly bonds between the rear plate 100 and the sealing portion conductive layer 7. The sealing portion conductive layer 7 airtightly bonds between the sealing portion insulating layer 5 and the conductive frame 23. The adhesion member 22 airtightly bonds between the conductive frame 23 and the face plate 200 (the second substrate 21).

The sealing portion insulating layer 5 will be described in detail. As described above, the rear plate 100 includes the first substrate 1, the potential regulating electrodes 8 and the matrix wires 9 (in this case, only the column wires 3 are shown), the latter two being provided on the first substrate 1. In addition, the potential regulating electrodes 8 and the matrix wire 9 are located at least between the conductive frame 23 and the first substrate 1. The sealing portion insulating layer 5 is provided between the matrix wires 9 and a sealing portion conductive member (the conductive frame 23 and the sealing portion conductive layer 7) to insulate therebetween in a Z direction. In order to improve the airtightness of the airtight container, as shown in FIG. 1B, the sealing portion insulating layer 5 is provided in the form of a frame along the conductive frame 23, that is, is provided continuously without having any breaks. In addition, the sealing portion insulating layer 5 extends on the first substrate 1 to between the potential regulating electrodes 8 and the matrix wires 9 and insulates therebetween in the X and Y directions. As described above, the sealing portion insulating layer 5 airtightly bonds between the sealing portion conductive member and the first substrate 1. As a result, the sealing portion insulating layer 5 is located between the potential regulating electrodes 8 and the sealing portion conductive member (the conductive frame 23 and the sealing portion conductive layer 7). Between the potential regulating electrodes 8 and the sealing portion conductive member (the conductive frame 23 and the sealing portion conductive layer 7), the sealing portion insulating layer 5 has the through-holes 6 each penetrating from the potential regulating electrode 8 toward the conductive frame 23 in the Z direction. Since the through-hole 6 is provided inside the sealing portion insulating layer 5, the inside of the through-hole 6 is surrounded by the sealing portion insulating layer 5 in the X and the Y directions. Inside the through-hole 6, a part of the sealing portion conductive layer 7 is located. The inside of the through-hole 6 is preferably filled with a part of the sealing portion conductive layer 7. In addition, the sealing portion conductive layer 7 is connected to (contacted with) the potential regulating electrode 8 through the through-hole 6. As a result, the potential regulating electrode 8 and the conductive frame 23 are conducted (electrically connected) to each other, and the potential regulating electrode 8, the sealing portion conductive layer 7, and the conductive frame 23 are at an equipotential. Furthermore, the potential regulating electrode 8 is preferably in contact with a conductive contact member (not shown) of the display apparatus, which is set at a predetermined potential, at the outside of the airtight container.

Accordingly, the potential regulating electrode 8 can be set at a predetermined potential approximately equivalent to that of the sealing portion conductive layer 7 and that of the conductive frame 23. The predetermined potential is preferably the ground potential. In addition, the way of contact between the potential regulating electrode 8 and the conductive contact member is not particularly limited, and abutment contact, pressing contact, or adhesion may be appropriately selected. Since the sealing member 300 is set at an equipotential, the influence of the potential distribution inside the airtight container on the outside thereof can be suppressed, and by suppressing the charging of the airtight container, the abnormal discharge which occurs in the vicinity of the sealing member 300 can also be suppressed. As described above, the sealing member 300 can function as a shield. Hence, the probability of damaging the matrix wires 9, the potential regulating electrodes 8, both of which are extended outside the airtight container, and the display unit provided inside the airtight container caused by abnormal discharge can be reduced, and a highly reliable display apparatus can be obtained.

Furthermore, according to the present invention, the potential regulating electrode 8 and the conductive frame 23 are connected inside the sealing member 300 and, in more particular, are connected inside the through-hole 6 of the sealing portion insulating layer 5. In addition, the connection between the potential regulating electrode 8 and the conductive frame 23 is performed by the sealing portion conductive layer 7 which is a part of the sealing member 300 and which airtightly bonds between the sealing portion insulating layer 5 and the conductive frame 23. Hence, an additional electrical conduction member for electrical conduction between the potential regulating electrode 8 and the conductive frame 23 is not necessarily provided on the surface of the sealing member 300, that is, on the outside or the inside surface of the airtight container. If the electrical conduction member is provided on the surface of the sealing member 300, sufficient electrical conduction may not be obtained or abnormal discharge may occur by a projection of the electrical conduction member in some cases. In addition, since the connection is performed within the space (through-hole 6) surrounded by the sealing portion insulating layer 5, the airtightness of the sealing member 300 is hardly degraded. Hence, the airtightness of the airtight container can be sufficiently ensured, and excellent display can be performed over a long period of time.

The structure described above may also be applied to a face plate 200 side, that is, may also be applied between the face plate 200 and the conductive frame 23. For example, when an anode wire is provided which extends through between the second substrate 21 and the conductive frame 23 from the outside of the airtight container, which is connected to the anode 26, and which sets the anode 26 at an anode potential, the above structure is preferably used. In this case, a potential regulating electrode is formed on the second substrate 21, and on the second substrate 21, a sealing portion insulating layer is provided so as to cover the anode wire and the potential regulating electrode. The sealing portion insulating layer insulates between the anode wire and the potential regulating electrode and insulates between the anode wire and the conductive frame 23. A through-hole is provided in the sealing portion insulating layer, and the potential regulating electrode on the second substrate 21 and the conductive adhesion member 22 are connected to each other through the through-hole. Accordingly, the electrical conduction between the conductive frame 23 and the potential regulating electrode of the face plate 200 can be obtained. However, a significantly high anode potential is applied to the anode wire as compared to that applied to the matrix wires. Hence, the sealing portion insulating layer at the face plate 200 side is required to have significantly high insulating properties as compared to those required for the sealing portion insulating layer which is provided at a rear plate 100 side. Hence, the thickness of the sealing portion insulating layer at the face plate 200 must be increased. When being provided at the rear plate 100 side, since the sealing portion insulating layer 5 may have a small thickness as compared to that in the case in which the sealing portion insulating layer is provided at the face plate 200 side, preferable electrical conduction can be obtained between the conductive frame 23 and the potential regulating electrode 8. As described above, the anode potential can be applied to the anode 26 through between the second substrate 21 and the conductive frame 23. However, it is preferable when the anode potential is applied to the anode 26 by an anode terminal provided by penetrating the rear plate 100. In this case, the potential regulating electrode 8 may extend inside the airtight container, and the anode terminal may be provided so as to surround the potential regulating electrode 8. Accordingly, the anode terminal can control the potential distribution generated in the interior space by the potential regulating electrode 8. The structure as described above may be seen, for example, in FIG. 5 of Japanese Patent Laid-Open No. 2003-092075.

Heretofore, the example of the display performed by cathode luminescence using the electron-emitting devices 11 (electron source 10) and the screen member 24 is described. In the display apparatus using the electron-emitting devices 11 and the screen member 24, since electron rays and a high anode potential are used, the control of the potential distribution of the whole display apparatus is important. Hence, the present invention can be preferably used. However, the display unit of the present invention is not limited only to that by the cathode luminescence. For example, a display unit by electroluminescence using organic EL elements, such as organic EL display, and a display unit by photoluminescence using gas discharge elements, such as plasma display, may also be used. In the organic electroluminescence display, since having not enough resistance against moisture, the organic EL elements are formed inside an airtight container for moisture protection. In addition, in the plasma display, since a discharge gas is enclosed, the gas discharge elements are formed inside an airtight container. According to the present invention, since the potential at the peripheral portion can be preferably set while the airtightness of the airtight container is ensured, a highly reliable display apparatus can be obtained.

Next, with reference to FIGS. 4A to 8E, one example of a method for manufacturing a display apparatus using SCE type electron-emitting devices will be described. FIGS. 4A to 7B are each a plan view of the rear plate in each step, and FIGS. 8A to 8E are each a schematic cross-sectional view of the portion shown by the chain line VIII-VIII in FIG. 1A.

Figure 4A:
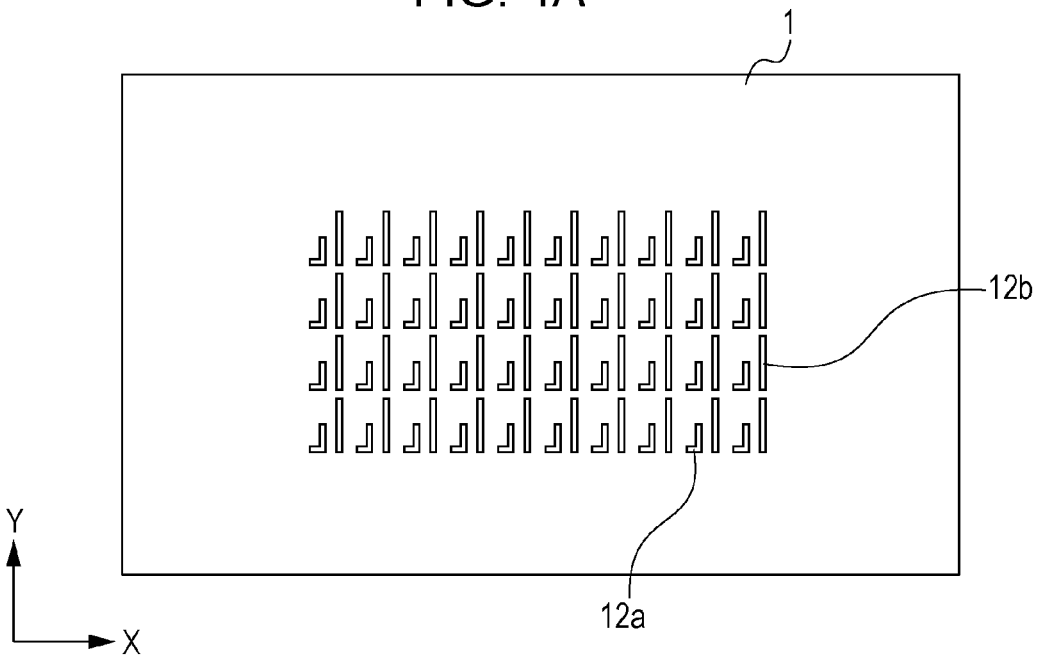
FIGS. 4A and 4B are schematic plan views each illustrating one example of a method for manufacturing a display apparatus.
Figure 8A:
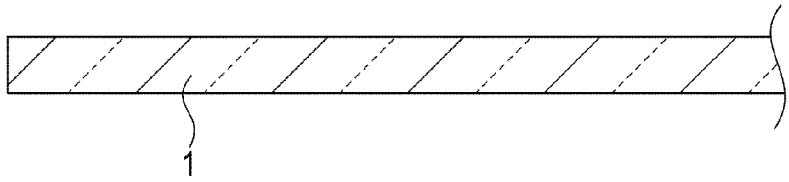
FIGS. 8A to 8E are schematic cross-sectional views each illustrating the method for manufacturing a display apparatus shown in FIGS. 4A and 4B.

On the first substrate 1 having a surface which is sufficiently washed beforehand, a film which serves as a material for device electrodes 12*a* and 12*b* is deposited by a general film formation technique. As the first substrate 1, a substrate having insulating properties is used, and more particularly, for example, a glass widely used for electronic devices, such as a quartz glass, an alkali free glass, or a blue plate glass, is used. The device electrodes 12*a* and 12*b* are formed from a conductive metal or the like by a general vacuum film formation technique, such as a CVD method, a deposition method, or a sputtering method. A material for the device electrodes 12*a* and 12*b* is appropriately selected, for example, from a metal, such as Be, Mg, Ti, Zr, Hf, V, Nb, Ta, Mo, W, Al, Cu, Ni, Cr, Au, Pt, or Pd, or an alloy thereof. In addition, for example, a carbide, such as TiC, ZrC, HfC, TaC, SiC, or WC, a boride, such as $HfB_2$, $ZrB_2$, $LaB_6$, $CeB_6$, $YB_4$, or $GbB_4$, a nitride, such as TaN, TiN, ZrN, or HfN, or a semiconductor, such as Si or Ge, may also be used. Furthermore, for example, an organic polymer material, amorphous carbon, graphite, diamond like carbon, or carbon or a carbon compound in which diamond is dispersed may also be selected. The thickness of each of the device electrodes 12*a* and 12*b* is appropriately selected. Next, after a photoresist is applied, a series of a photolithographic technique including exposure, development, and etching is performed to remove a part of the film thus deposited, so that the device electrodes 12*a* and 12*b* are formed (FIG. 4A and FIG. 8A). According to one example, after slit coating of a photoresist, mask pattern exposure, and development are sequentially performed, the deposited film is partially removed by etching, so that the device electrodes 12*a* and 12*b* are formed. The etching method may be appropriately selectable in accordance with the material for the device electrodes 12*a* and 12*b*.

Figure 4B:
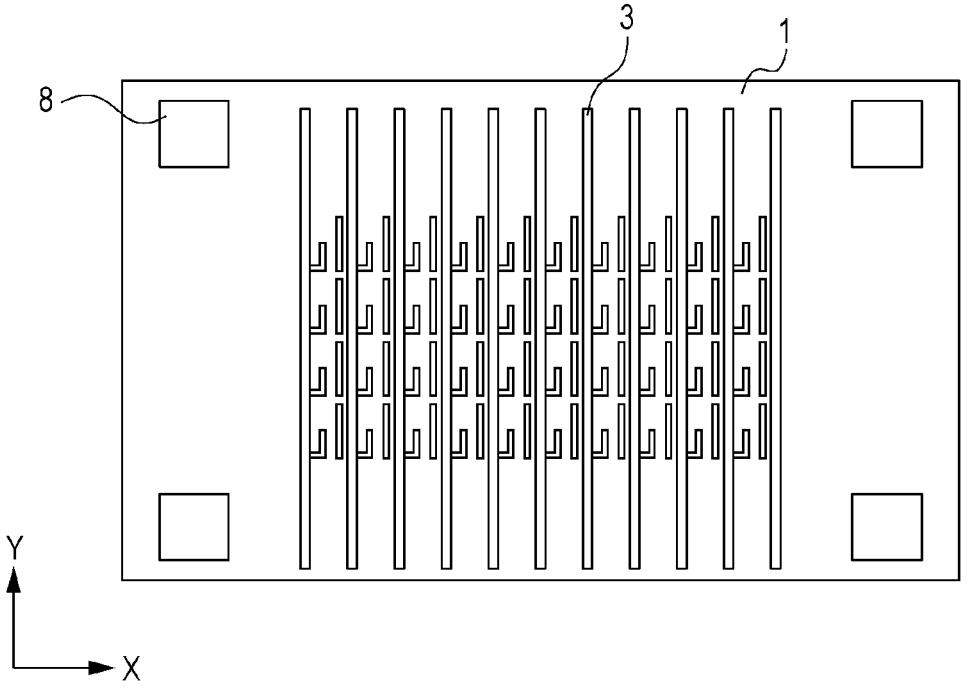
Figure 8B:
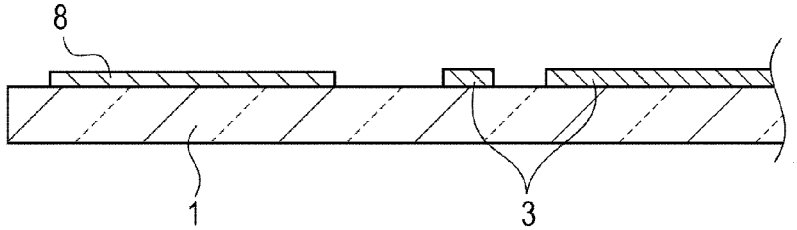

After a photosensitive conductive paste is applied on the first substrate 1 by screen printing or the like, the column wires 3 having a predetermined pattern are formed by a photolithographic technique (FIG. 4B and FIG. 8B). In this step, the column wires 3 are connected to the respective device electrodes 12*a*. Alternatively, in this process, after a film is formed using a conductive metal or the like on the entire surface of the substrate by a general vacuum film formation technique, such as a CVD method, a deposition method, or a sputtering method, the film my be patterned by a series of a photolithographic method including coating of a photoresist, exposure, development, and etching to form the column wires 3. In addition, a material for the column wire 3 and the thickness and width thereof may be appropriately selected.

Subsequently, the potential regulating electrode 8 composed of at least one line is formed on at least one of four corners of the substrate 1 at which the column wires 3 are not arranged (FIG. 4B and FIG. 8B). The potential regulating electrode may be formed by a general vacuum film formation technique, such as a deposition method or a sputtering method, or may be formed by a printing technique. The potential regulating electrode 8 is formed from a conductive paste prepared as a printing ink by screen printing or the like or is formed from a conductive metal or the like by a general vacuum film formation technique, such as a CVD method, a deposition method, or a sputtering method. A material for the potential regulating electrode 8 may be the same as or different from that for the row wire 2 and the column wire 3. The thickness and width of the potential regulating electrode 8 may be appropriately designed. In addition, the potential regulating electrode 8 may be formed simultaneously with the column wires 3, and in this case, the thickness and width of the potential regulating electrode 8 are appropriately selected in accordance with the thickness and width of the column wire 3. Furthermore, in consideration of the case of break of the potential regulating electrode 8, the potential regulating electrode 8 is preferably formed of a bundle wire in which a plurality of fine lines are arranged in parallel on the first substrate 1.

Figure 5A:
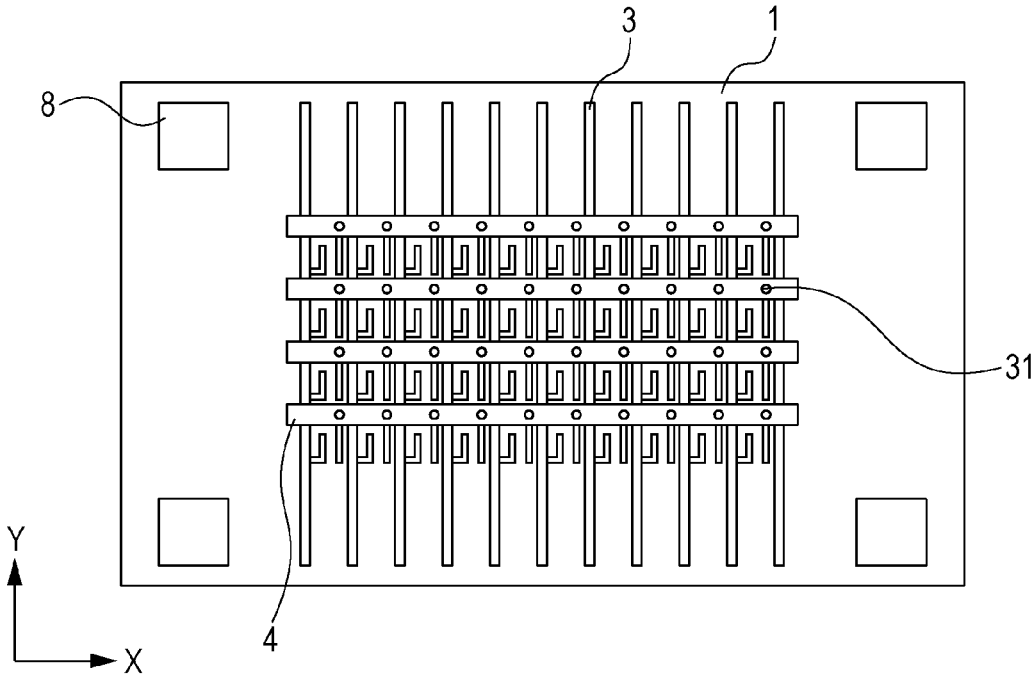
FIGS. 5A and 5B are schematic plan views each illustrating the method for manufacturing a display apparatus shown in FIGS. 4A and 4B.

Next, a film which is used as a material for the wire insulating layers 4 is formed on the first substrate 1, the column wires 3, the device electrodes 12*a* and 12*b*, and the potential regulating electrodes 8 by a general vacuum film formation method, such as a sputtering method, a CVD method, or a deposition method. Subsequently, by a photolithographic technique, this film thus deposited is partially removed, so that the wire insulating layers 4 are formed (FIG. 5A). As the material for the wire insulating layer 4, for example, an oxide such as $SiO_2$ or a nitride such as $Si_3N_4$ may be mentioned, and a material having a high withstand voltage, which can withstand a high electric field, is selected. In this step, contact holes 31 are formed in the films at desired positions. This contact hole 31 is formed so as to overlap with the device electrode 12*b* and is designed to ensure electrical conduction therewith. An etching method may be appropriately selected in accordance with the material for the wire insulating layer 4. For example, when $SiO_2$ is used for the wire insulating layer 4, wet etching is performed using buffered fluoric acid as an etchant.

Figure 5B:
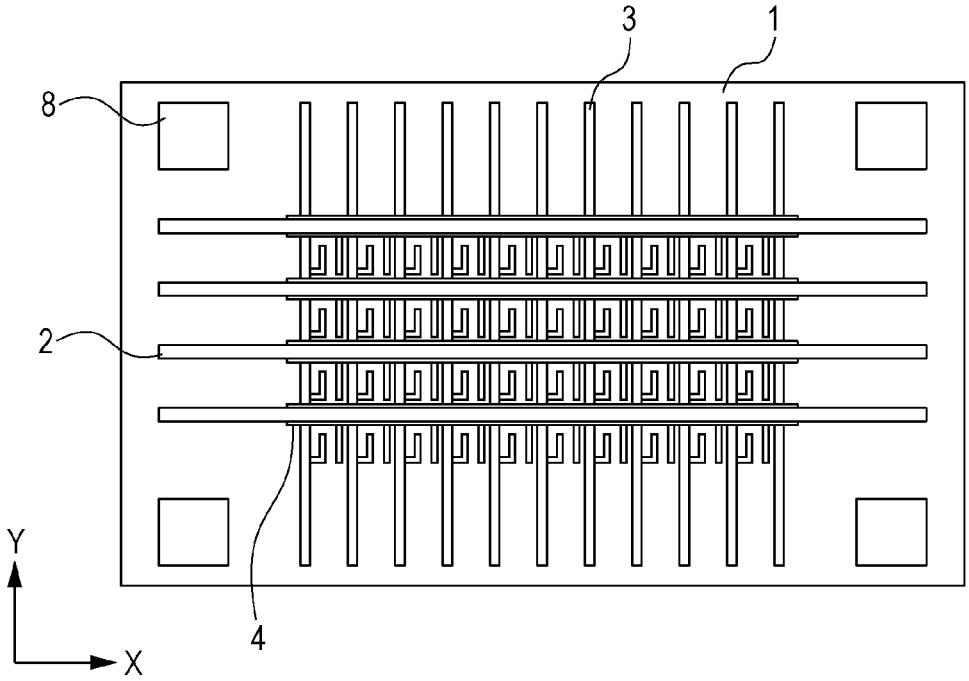

Next, the row wires 2 are formed on the wire insulating layers 4 (FIG. 5B). The row wires 2 may be formed by a general vacuum film formation technique, such as a deposition method or a sputtering method, or may be formed by a printing technique. A method for manufacturing the row wires 2 may be appropriately selected in accordance with the thickness and width of the row wire 2. The row wires 2 may be formed by the same method as that for the column wires 3 or may be formed by a different method. A material for the row wire 2 may be the same as or different from the material for the column wire 3.

By the step described above, the contact hole 31 is filled with the material for the row wire 2, and the device electrode 12*b* is connected to the row wire 2 through the contact hole 31.

Figure 6A:
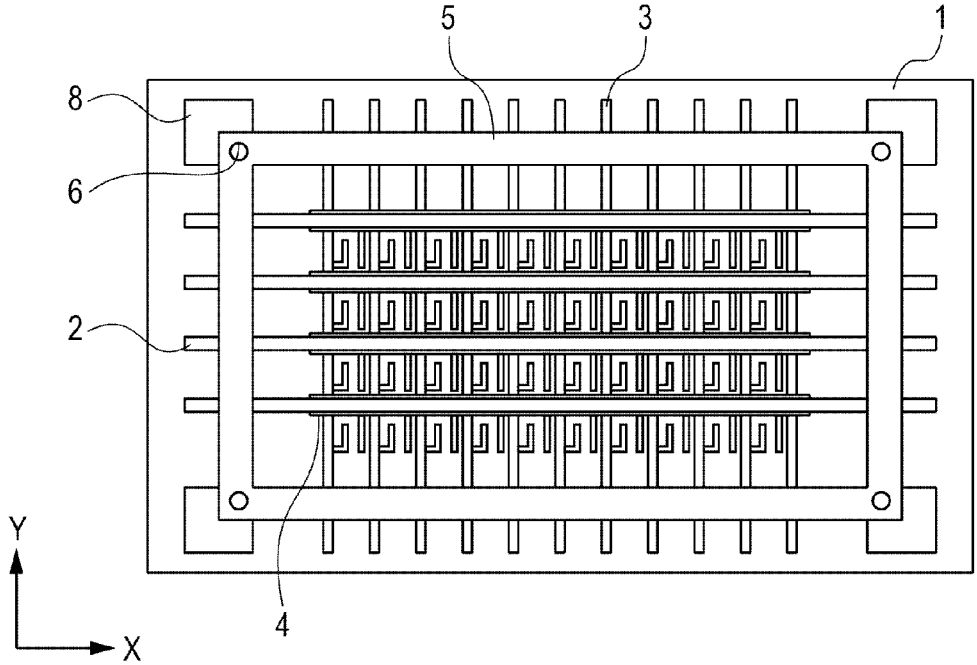
FIGS. 6A and 6B are schematic plan views each illustrating the method for manufacturing a display apparatus shown in FIGS. 4A and 4B.
Figure 8C:
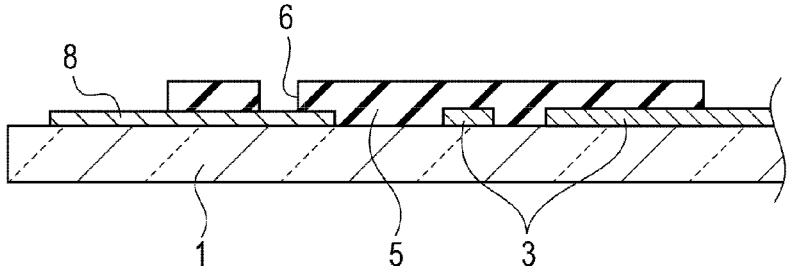

Next, at least on the first substrate 1, the row wires 2, the column wires 3, and the potential regulating electrodes 8, a photosensitive film which is used as a material for the sealing portion insulating layer 5 is formed by a lamination method. Subsequently, by mask pattern exposure and development, the photosensitive film thus formed is partially removed. In this step, the through-holes 6 are formed in the photosensitive film at desired positions (typically at four corners). Next, the sealing portion insulating layer 5 is formed by firing (FIG. 6A and FIG. 8C). The through-hole 6 and a part of the sealing portion insulating layer 5 are formed so as to overlap with the potential regulating electrode 8. In consideration of the size of the conductive frame 23, the sealing portion insulating layer 5 is formed so as to be located at an appropriate position (within the acceptable range of the displacement of the conductive frame 23). As a material for the sealing portion insulating layer 5, for example, a Pb-based or a Bi-based photosensitive glass paste may be mentioned, and a material having a high withstand voltage, which can withstand a high electric field, may be selected. The thickness and width of the sealing portion insulating layer 5 are appropriately designed. The size of the opening of the through-hole 6 is designed so as to ensure the electrical conduction with the potential regulating electrode 8 and the airtightness. This sealing portion insulating layer 5 may be formed by a general vacuum film formation technique, such as a deposition method or a sputtering method, or may be formed by a printing technique. In addition, the sealing portion insulating layer 5 and the wire insulating layers 4 may be simultaneously formed.

Figure 6B:
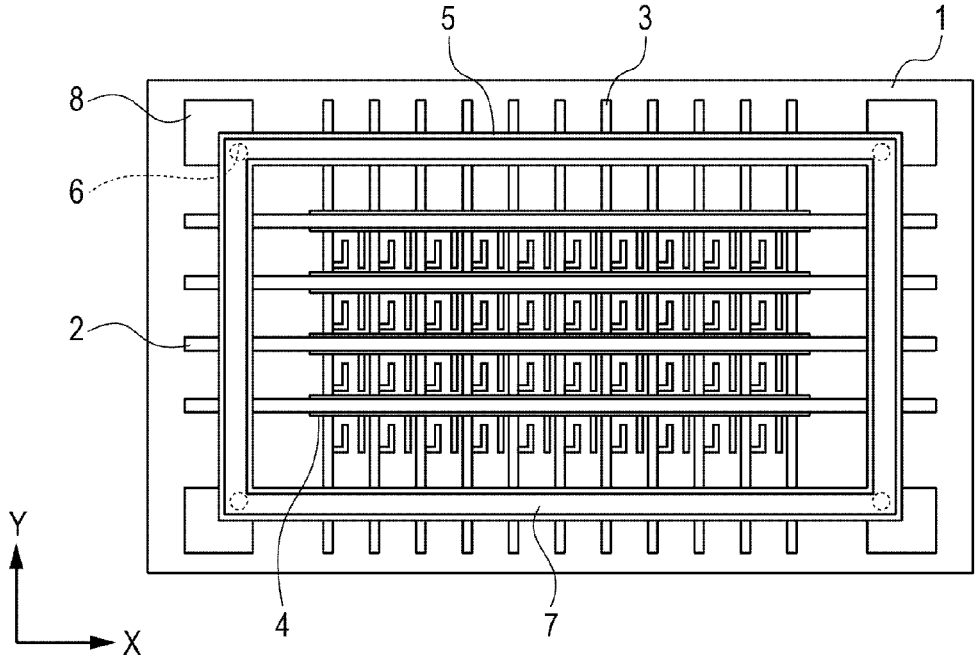
Figure 8D:
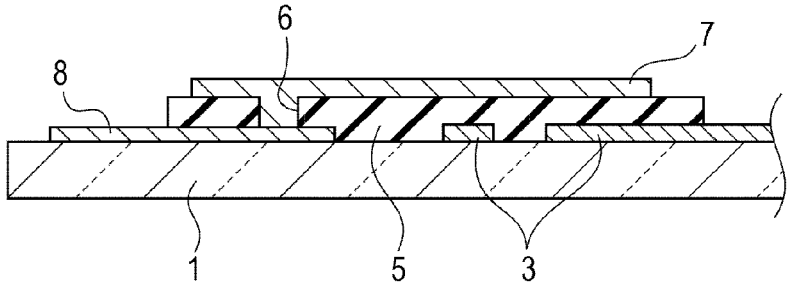

Next, after a conductive material to be formed into the sealing portion conductive layer 7 is pattern-printed on the sealing portion insulating layer 5 by a screen printing method or the like, drying and firing are performed, so that the sealing portion conductive layer 7 is formed (FIG. 6B and FIG. 8D). A firing temperature is appropriately selected in accordance with the conductive material. In addition, the thickness of the sealing portion conductive layer 7 is appropriately designed. In this process, the sealing portion conductive layer 7 and the potential regulating electrode 8 can be bonded to each other since the conductive material which is formed into the sealing portion conductive layer 7 is filled in the through-hole 6. As the conductive material for the sealing portion conductive layer 7, a metal, such as In, Al, Cu, Au, Ag, Pt, Ti, or Ni, or an alloy thereof may be used. In a general structure, the sealing portion conductive layer 7 is a conductive adhesion member which airtightly adheres between the sealing portion insulating layer 5 and the conductive frame 23. Hence, as the material, a low melting point metal having a melting point of 400° C. or less is preferable, and in particular, In is preferable. The adhesion member 22 is also preferably a conductive adhesion member.

Figure 7A:
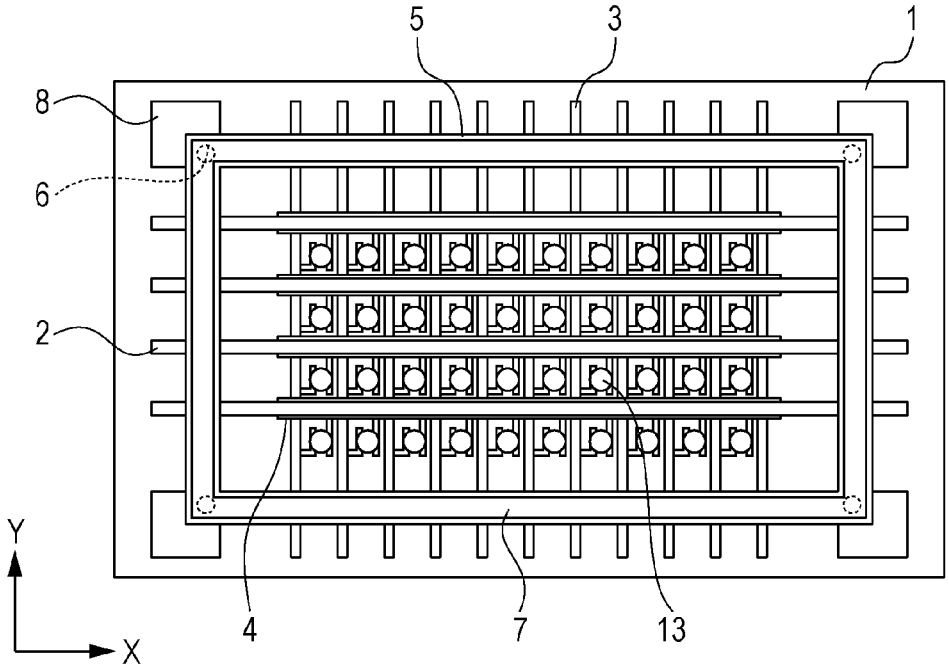
FIGS. 7A and 7B are schematic plan views each illustrating the method for manufacturing a display apparatus shown in FIGS. 4A and 4B.
Figure 7B:
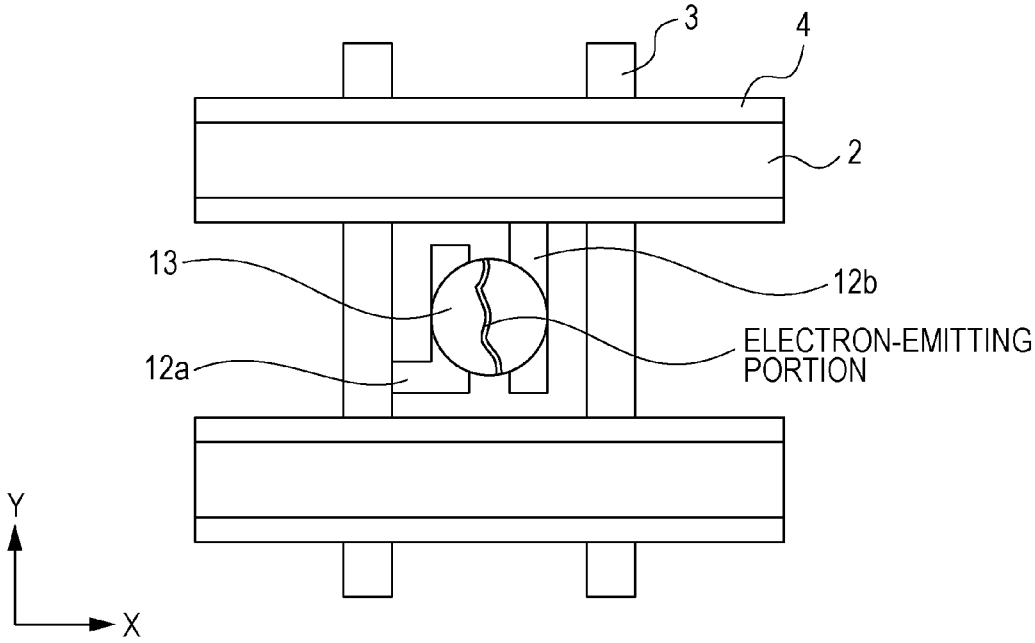

Next, electron emission films 13 are formed. First, conductive films are each formed so as to be connected to the device electrodes 12*a* and 12*b* (FIG. 7A). The conductive films may also be formed by a sputtering method, a vacuum deposition method, a CVD method, or the like. The conductive films may also be formed by applying a compound solution containing a material for the conductive film by a dipping method, a spin coating method, an ink jet method, or the like. A material for the conductive film may be appropriately selected, for example, from Pd, Pt, Ru, PdO, and $SnO_2$. The thickness of the conductive film is appropriately determined. Next, an electrical power is supplied to the conductive film through the row wire 2 and the column wire 3, so that an energization forming treatment and an energization activation treatment are performed. By the steps described above, the electron emission film 13 having an electron emission portion is formed (FIG. 7B and FIG. 1B).

Although a substrate having insulating properties is used as the second substrate 21 as in the case of the first substrate 1, a substrate transparent to visible light is used for performing display. The screen member 24 includes the luminous layers 25, the anode 26 which is called a metal back, and the light shielding layer 27 which is called a black matrix (or black stripe). When the luminous layer 25 is monochrome, the light shielding layer 27 may be omitted. In the case of color display, in accordance with the arrangement of the luminous layers 25, the light shielding layer 27 is formed. The reasons the light shielding layer 27 is used are that color mixture is made inconspicuous by blacking portions between three primary color fluorescent substances which are necessary in the case of color display and that a decrease in contrast by outside light reflection at the luminous layer 25 is suppressed. As a material for the light shielding layer 27, besides a commonly used material containing graphite as a primary component, a material having electrical conductivity and small light transmission and reflection may also be used.

As a method for forming the luminous layer 25, which is a part of the screen member 24, by applying a fluorescent substance, regardless of whether monochrome or color, for example, a precipitation method or a printing method may be used. At an inner surface side of the luminous layers 25, a metal back is provided as the anode 26. The metal back is formed in such a way that after the luminous layers 25 are formed, the surfaces thereof at the inner surface side are smoothed (usually called "filming"), and Al is then deposited by vacuum deposition or the like. As the anode 26, a transparent conductive film, such as indium tin oxide (ITO), may also be used instead of the metal back, and in this case, the transparent conductive film may also be arranged between the second substrate 21 and the luminous layers 25.

The adhesion member 22 used as a bond portion with the conductive frame 23 is formed in the vicinity of the screen member 24 on the second substrate 21. As the adhesion member 22, a conductive member is used as in the case of the sealing portion conductive layer 7. Although the adhesion member 22 and the sealing portion conductive layer 7 may use different conductive members, the same conductive member is preferably used. After the conductive member used as a material for the adhesion member 22 is arranged by a screen printing method or the like, the adhesion member 22 is formed by drying and firing. In consideration of the size of the conductive frame 23, the adhesion member 22 is formed so as to be located at an appropriate position (within the acceptable range of the displacement of the conductive frame 23). A firing temperature is appropriately selected in accordance with the conductive member. In addition, the thickness of the adhesion member 22 is also appropriately designed. When the adhesion member 22 is directly formed on the second substrate 21, the potential regulation of the face plate 200 can be reliably performed by the adhesion member 22 from the potential regulating electrode 8 of the rear plate 100 through the conductive frame 23.

Figure 8E:
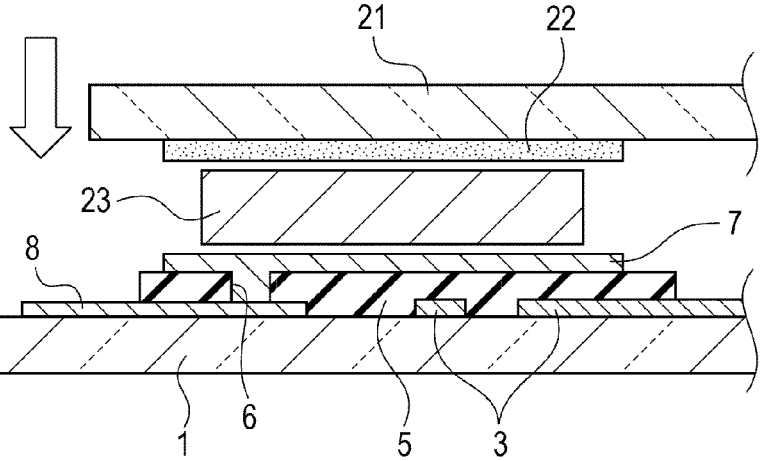

The rear plate 100 and the face plate 200 are placed in a vacuum chamber (not shown) in which heating of the substrate, alignment (X, Y), and gap control can be performed. In the vacuum chamber, the conductive frame 23 is placed on the rear plate 100, and the rear plate 100 and the face plate 200 are aligned to each other using alignment marks (not shown) formed therein (FIG. 8E). In this step, the rear plate 100 and the face plate 200 are located with a gap interposed therebetween so as not to be brought into contact with each other. In the conductive frame 23, at least approximately the entire surface thereof may have electrical conductive properties. Although a conductive film may be formed on the surface of a glass-made frame, in view of the processability, the frame is preferably formed of a metal, such as aluminum or iron, or an alloy thereof. As the metal, a surface treatment, such as plating, performed on the surface of the conductive frame 23 may also be included. The thickness of the conductive frame 23 is determined in accordance with the gap between the rear plate 100 and the face plate 200 and is typically in a range of approximately several hundreds of micrometers to several millimeters.

Under this condition, the temperature of the rear plate 100 and that of the face plate 200 are increased in the chamber to a melting point of the sealing portion conductive layer 7 and that of the adhesion member 22. Next, the rear plate 100 is placed closer to the face plate 200, and the sealing portion conductive layer 7, the conductive frame 23, and the adhesion member 22 are adhered to each other. The step described above is carefully performed so that a low melting point metal may not overflow over each side of the conductive frame 23. Subsequently, by decreasing a substrate temperature, the rear plate 100 and the face plate 200 are airtightly bonded to the conductive frame 23, so that the airtight container is formed. In this sealing step, the potential regulating electrodes 8 of the rear plate 100 and the conductive frame 23 are electrically connected to each other by the sealing portion conductive layer 7 through the through-holes 6. In addition, a conductive contact member (not shown) which is set at a predetermined potential is brought into contact with the potential regulating electrode 8. For the conductive contact member, a conductive tape, an electrical cable, or a metallic member having an elastic section, each of which is set at a predetermined potential, may be used. When the conductive contact member is electrically connected to a supporting member (such as a chassis) or a housing (such as a cover) of the airtight container of the display apparatus or a GND line of an electrical circuit, grounding can be performed. When being set at a potential other than the ground potential, the conductive contact member is connected to the electrical circuit. The contact way of the conductive contact member described above may be seen, for example, in FIGS. 8 to 16 of Japanese Patent Laid-Open No. 2003-092075. Accordingly, the potential regulating electrode 8 of the rear plate 100 to the conductive frame 23 and further to the conductive adhesion member 22 at a face plate 200 side can be set at an equipotential (predetermined potential).

EXAMPLE

Hereinafter, the present invention will be described in detail with reference to a particular example.

[Formation of Device Electrodes]

As the first substrate 1, a high strain point glass PD200 (manufactured by Asahi Glass Co., Ltd.) having a thickness of 1.8 mm, which was generally used for plasma display panel and the like, was used. Platinum (Pt) (20 nm in thickness) was deposited on this glass substrate 1 by a sputtering method. Next, slit coating of a positive type photoresist (TSMR-8900/Tokyo Ohka Kogyo Co., Ltd.) was performed by a photolithographic process. Then, after the photoresist was exposed using a photomask pattern, followed by development, dry etching was performed using an Ar gas, and etching was stopped on the first substrate 1, so that the device electrodes 12*a* and 12*b* were formed (FIG. 4A).

[Formation of Column Wires]

Subsequently, a Cu film having a thickness of 1.0 μm was deposited by a sputtering method on the first substrate 1 and the device electrodes 12*a* and 12*b*. Next, a resist pattern was formed by a photolithographic process as in the case of the previous step. Subsequently, wet etching was performed for 1 minute using the photoresist thus patterned as a mask and SEA-1 (manufactured by Kanto Chemical Co., Inc.) as an etchant, so that the column wires 3 were formed to have a width of 20 μm (FIG. 4B). The column wires 3 were formed so as to overlap with the device electrodes 12*a*.

[Formation of Conductive Member]

In the previous process, the potential regulating electrodes 8 each formed of a bundle wire of 20 lines were simultaneously formed at four corners of the substrate 1 at which the column wires 3 are not arranged thereon (FIG. 4B). The width and the thickness of one line of the potential regulating electrode 8 are the same as those of the column wire 3.

[Formation of Wire Insulating Layers]

Next, a SiO2 film having a thickness of 2.0 μm for the wire insulating layers 4 was deposited on the first substrate 1, the column wires 3, the device electrodes 12*a* and 12*b*, and the potential regulating electrodes 8 by a CVD method. Subsequently, a resist pattern was formed by a photolithographic process. Next, the wire insulating layers 4 and the contact holes 31 for exposing the device electrodes 12*a* and 12*b* were formed by etching parts of the SiO2 film using the photoresist thus patterned as a mask (FIG. 5A). Etching was performed for 10 minutes using LAL1000 (manufactured by Stella Chemifa Corporation) as an etchant. The contact hole 31 had an opening diameter of 100 μm and was formed so as to overlap with the device electrode 12*b*.

[Formation of Row Wires]

Next, on the wire insulating layers 4, Cu films having a thickness of 3.0 μm and a width of 300 μm were formed as the row wires 2 by a printing technique using a mask (FIG. 5B). The row wires 2 overlapped with the device electrodes 12*b* with the wire insulating layers 4 interposed therebetween and were connected to the device electrodes 12*b* through the contact holes 31 formed in the wire insulating layers 4.

[Formation of Sealing Portion Insulating Layer]

Next, a photosensitive film used as a material for the sealing portion insulating layer 5 was formed by a lamination method on the first substrate 1, the row wires 2, the column wires 3, the device electrodes 12*a* and 12*b*, the potential regulating electrodes 8, and the wire insulating layers 4. JIF (manufactured by JSR Corp.) which was a glass paste was used for the photosensitive film. Then, after exposure was performed using a mask, patterning was performed by development using a sodium carbonate solution at a concentration of 0.4%, followed by firing at a temperature of 400° C., so that the sealing portion insulating layer 5 was formed (FIG. 6A). In this step, the through-holes 6 were formed in the sealing portion insulating layer 5. The through-holes 6 were formed to have an opening diameter of 100 μm at four positions so as to overlap with the potential regulating electrodes formed beforehand, and the thickness and width of the sealing portion insulating layer 5 after firing were 30 μm and 10 mm, respectively.

[Formation of Adhesion Member]

Next, after an Ag paste ink was arranged on the sealing portion insulating layer 5 by a screen printing method and was then dried, firing was performed at a temperature of 480° C., so that the sealing portion conductive layer 7 was formed. The thickness of the sealing portion conductive layer 7 after the firing was 3 μm. In this example, when the sealing portion conductive layer 7 was formed, the Ag paste was allowed to flow in the through-holes 6 and was filled therein, and as a result, the potential regulating electrodes 8 were electrically connected to the sealing portion conductive layer 7 (FIG. 6B).

[Formation of Electron-Emitting Devices]

Next, a palladium proline complex was dissolved in isopropyl alcohol and was applied between the device electrodes 12*a* and 12*b* to form a dot shape having a diameter of 60 μm using an ink jet ejection device. Subsequently, a heat firing treatment was performed on this substrate at 350° C. for 10 minutes in the air, so that conductive films were formed (FIG. 7A). Then, an energization forming treatment and an energization activation treatment were performed, and as a result, the electron emission films 13 each of which had an electron emission portion were formed (FIG. 7B).

In the rear plate 100 of this example, when the resistance between the sealing portion conductive layer 7 and the potential regulating electrode 8 was measured by a tester, the resistance was approximately 0Ω, and hence it was confirmed that short circuit was obtained.

[Formation of Face Plate]

The glass substrate 21 formed of a high strain point glass PD200 (manufactured by Asahi Glass Co., Ltd.) having a thickness of 1.8 mm was annealed and washed. Next, the light shielding layer 27 which had openings was formed to have a thickness of 10 μm by a screen printing method using a black pigment paste containing a glass paste and a black pigment. The size of the opening was 75 μm in the X direction and 200 μm in the Y direction. Subsequently, three primary color fluorescent substance films of R (red), G (green), and B (blue) were applied to the openings by a screen printing method. In this case, in the X direction, R (red), G (green), and B (blue) were arranged in this order, and in the Y direction, the fluorescent substances having the same color were arranged. Next, the metal back was formed as the anode 26 using a filming method which was well known in a cathode ray tube (CRT) field. After a resin interlayer was formed on the fluorescent substance films, aluminum was formed to have a thickness of 100 nm by a vacuum deposition method. Subsequently, firing was performed at 450° C., so that the resin interlayer was removed. Next, after an Ag paste ink was applied to the glass substrate 21 at positions apart from the screen member 24, followed by drying, firing was performed at a temperature of 480° C., so that the adhesion member 22 was formed. The thickness of the adhesion member 22 after the firing was 3 μm.

[Sealing of Rear Plate and Face Plate]

Heat press bonding was performed in a vacuum furnace on the rear plate 100, the face plate 200, and the conductive frame 23 of aluminum, so that the rear plate 100, the conductive frame 23, and the face plate 200 were collectively vacuum sealed. In the vacuum sealing, a glass spacer (not shown) having a thickness of 2 mm which accurately defined the gap between substrates was provided between the rear plate 100 and the face plate 200, so that the gap therebetween was made constant. In this heat press bonding step, the sealing portion conductive layer 7 of Ag and the adhesion member 22 were tightly bonded to the conductive frame 23, and as a result, the airtight container was formed. As described above, the display apparatus was formed. In the display apparatus of this example, when the resistance between the adhesion member 22 and the potential regulating electrode 8 was measured by a tester, the resistance was approximately 0Ω, and it was confirmed that short circuit was obtained.

The electron-emitting devices 11 were each driven by applying a scanning signal to the row wire 2 of the display apparatus thus formed and by applying an information signal to the column wire 3 thereof. A pulse voltage of +6 V was used as the information signal, and as the scanning signal, a pulse voltage of −10 V was used. Display was performed by applying an anode potential of 6 kV to the metal back. In addition, the electric potential regulation electrodes 8 were grounded. Although the display was observed continuously for 24 hours, no discharge occurred, and a bright image could be stably displayed. Furthermore, although the anode potential was set at 12 kV, and display was performed for 1 hour, no discharge occurred.

COMPARATIVE EXAMPLE

A rear plate used for comparison was formed by a process similar to that in Example 1 except that no through-holes 6 were formed in the sealing portion insulating layer 5. Instead of forming the through-holes 6, the following [formation of conductive film] process was performed after the above [formation of sealing portion insulating layer].

[Formation of Conductive Film]

Indium was applied using a dispenser to a position from the side surfaces to the upper surface of the sealing portion insulating layer 5 which overlapped with the potential regulating electrodes 8 so as to be brought into contact with the potential regulating electrodes 8 and the conductive frame 23, so that an electrical conduction film was formed.

When a cross-sectional shape of the sealing portion insulating layer was observed by a scanning electron microscope (SEM), the thickness of the conductive film was not uniformly formed, and a disconnected portion was also observed. When the resistance between the sealing portion conductive layer 7 and the potential regulating electrode 8 was measured by a tester, the resistance was 3 MΩ, and the electrical conductivity was inferior.

Furthermore, sealing was performed with the face plate 200, and the display apparatus was formed. As in the case of the example, when the anode potential was set at 12 kV, and the display was performed for 1 hour, discharge occurred.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-274966 filed Dec. 2, 2009, which is hereby incorporated by reference herein in its entirety.

What is claimed is:

1. A display apparatus comprising:

an airtight container including:

an insulating first substrate;

an insulating second substrate facing the first substrate;

a conductive frame arranged between the first substrate and the second substrate;

a conductive layer which is provided between the conductive frame and the first substrate and which is airtightly bonded to the conductive frame; and an insulating layer which is provided between the conductive layer and the first substrate and which airtightly bonds between the conductive layer and the first substrate, a display unit provided inside the airtight container;

wires which extend from the outside of the airtight container to the inside thereof through between the first substrate and the insulating layer and which are connected to the display unit; and at least one electrode which extends from the outside of the airtight container to at least between the first substrate and the insulating layer, wherein the insulating layer insulates the wires from the conductive frame and the electrode and has at least one through-hole penetrating from the electrode toward the conductive frame, and the conductive layer is connected to the electrode through the through-hole.

2. The display apparatus according to claim 1, wherein the display unit includes electron-emitting devices provided on the first substrate and a screen member which is provided on the second substrate to face the electron-emitting devices and which includes an anode and luminous layers laminated thereon, and the wires are connected to the electron-emitting devices.

3. The display apparatus according to claim 1, wherein the electrode is set at a predetermined potential.

4. The display apparatus according to claim 3, wherein the predetermined potential is the ground potential.

* * * * *